US011176868B2

(12) United States Patent
Park et al.

(10) Patent No.: US 11,176,868 B2
(45) Date of Patent: Nov. 16, 2021

(54) DEVICE AND METHOD FOR DRIVING DISPLAY

(71) Applicant: Anapass Inc., Seoul (KR)

(72) Inventors: Joon Bae Park, Seoul (KR); Jun Young Jang, Seoul (KR); Hyun Seung Lee, Seoul (KR); Dong Joon Lee, Seoul (KR)

(73) Assignee: Anapass Inc., Seoul (KR)

( * ) Notice: Subject to any disclaimer, the term of this patent is extended or adjusted under 35 U.S.C. 154(b) by 0 days.

(21) Appl. No.: 17/121,123

(22) Filed: Dec. 14, 2020

(65) Prior Publication Data

US 2021/0256895 A1 Aug. 19, 2021

(30) Foreign Application Priority Data

Feb. 13, 2020 (KR) ..... 10-2020-0017647

(51) Int. Cl.
*G09G 3/20* (2006.01)

(52) U.S. Cl.
CPC ... *G09G 3/2007* (2013.01); *G09G 2320/0209* (2013.01); *G09G 2360/16* (2013.01)

(58) Field of Classification Search
CPC ..... G09G 3/2007; G09G 2320/0209; G09G 2320/0233; G09G 2360/16
See application file for complete search history.

(56) References Cited

U.S. PATENT DOCUMENTS

| | | | | |
|---|---|---|---|---|
| 8,072,506 | B2 * | 12/2011 | Jang | H04N 5/2357 348/226.1 |
| 8,922,602 | B2 * | 12/2014 | Choi | G09G 3/3688 345/694 |
| 9,137,424 | B2 * | 9/2015 | Jang | H04N 5/145 |
| 9,741,281 | B2 * | 8/2017 | Kim | G09G 3/3291 |
| 10,522,100 | B2 * | 12/2019 | Jeong | G09G 3/3607 |
| 2006/0022914 | A1 * | 2/2006 | Kimura | G09G 3/2014 345/76 |
| 2006/0158531 | A1 * | 7/2006 | Yanof | H04N 5/2357 348/226.1 |

FOREIGN PATENT DOCUMENTS

| | | | |
|---|---|---|---|
| KR | 10-2009-0097369 | A | 9/2009 |
| KR | 10-2013-0124088 | A | 11/2013 |
| KR | 10-2014-0020059 | A | 2/2014 |

* cited by examiner

*Primary Examiner* — Gene W Lee
(74) *Attorney, Agent, or Firm* — Paratus Law Group, PLLC

(57) ABSTRACT

Disclosed is a method for driving a display. The method includes calculating differences between digital codes corresponding to grayscale voltages each provided to pixels connected to the same data line and gate lines which are sequentially driven, summing digital code differences of a threshold value or more, generating a compensation code corresponding to the summation result, and providing grayscale voltages compensated with the compensation code to pixels of which digital codes have a difference of less than the threshold value.

21 Claims, 6 Drawing Sheets

DEVICE AND METHOD FOR DRIVING DISPLAY

CROSS-REFERENCE TO RELATED APPLICATION

This application claims priority to and the benefit of Korean Patent Application No. 10-2020-0017647, filed on Feb. 13, 2020, the disclosure of which is incorporated herein by reference in its entirety.

BACKGROUND

The present invention relates to a device and method for driving a display.

Various electronic devices including cellular phones, tablet computers, etc. have a display unit for displaying information to a user. The display unit includes a display panel and circuitry, such as a source driver, a gate driver, and a timing controller, for driving the display panel.

The source driver generates grayscale voltages corresponding to input digital codes and provides the grayscale voltages to pixels included in the display panel through a data line. The gate driver provides gate signals to pixels connected to a gate line so that the pixels connected to the gate line may emit light of a grayscale level corresponding to grayscale voltages.

SUMMARY

In one frame image, areas which have a large grayscale difference, such as a white area and a black area, may be adjacent to each other. In this case, crosstalk may occur, which is an abnormal characteristic of an amplifier included in a source driver for generating grayscale voltages corresponding to the areas.

As an example, the upper half of one frame image may display white, the left side of the lower half may display black, and the right side of the lower half may display white. In this case, a line at the boundary between the lower right side and the upper half may display a brighter color than the surrounding white due to crosstalk which is an abnormal characteristic.

Also, the left side of the upper half of one frame image may display black, the right side of the upper half may display white, and the lower half may display white. Even in this case, a line at the boundary between the upper right side and the lower half may display a darker color than the surrounding white due to crosstalk which is an abnormal characteristic.

The present invention is directed to solving abnormal effects caused by crosstalk.

According to an aspect of the present disclosure, there is provided a method of driving a display including calculating differences between digital codes corresponding to grayscale voltages each provided to pixels connected to the same data line and gate lines which are sequentially driven, summing the differences between the digital codes, generating a compensation code corresponding to a result of the summation, generating compensated grayscale codes by adding the compensation code to the digital codes corresponding to the grayscale voltages, and providing grayscale voltages corresponding to the compensated grayscale codes.

The calculating of the differences between the digital codes may include calculating a difference between a digital code corresponding to a grayscale voltage provided to a pixel driven $k^{th}$ and a digital code corresponding to a grayscale voltage provided to a pixel driven $(k+1)^{th}$.

The calculating of the differences between the digital codes may include calculating a difference between digital codes corresponding to grayscale voltages each provided to pixels connected to the same data line and two gate lines which are sequentially driven.

The method may further include comparing the differences between the digital codes with a threshold value and, when the differences between the digital codes are smaller than the threshold value, discarding the differences between the digital codes.

The method may further include comparing the result of summing the differences between the digital codes with a threshold value and, when the summation result is smaller than the threshold value, discarding the summation result.

The threshold value may correspond to the highest grayscale voltage difference at which an abnormal characteristic does not result from crosstalk.

The generating of the compensation code may include multiplying the summation result by a constant.

The constant may have a value varying according to the summation result.

The constant may have a larger value according to an increase in the summation result.

The constant may have a fixed value.

The method may be performed by any one of a source driver and a timing controller.

The providing of the grayscale voltages corresponding to the compensated grayscale codes may include providing the grayscale voltages corresponding to the compensated grayscale codes to the pixels of which the digital codes have a difference of less than the threshold value.

According to another aspect of the present disclosure, there is provided a device for driving a display, the device including subtractors configured to calculate differences between digital codes corresponding to grayscale voltages each provided to pixels connected to the same data line and gate lines which are sequentially driven, a first adder configured to sum the differences between the digital codes, a multiplier configured to generate a compensation code by multiplying a result of the summation by a constant, and a second adder configured to generate compensated grayscale codes by adding the compensation code to the digital codes corresponding to the grayscale voltages.

The subtractors may calculate a difference between a digital code corresponding to a grayscale voltage provided to a pixel driven $k^{th}$ and a digital code corresponding to a grayscale voltage provided to a pixel driven $(k+1)^{th}$.

The device may further include comparators configured to compare the differences between the digital codes with a threshold value, and when the differences between the digital codes are smaller than the threshold value, the comparators may discard the differences between the digital codes.

The device may further include a comparator configured to compare the result, which is a calculation result of the first adder obtained by summing the differences between the digital codes, with a threshold value, and when the summation result is smaller than the threshold value, the comparator may discard the differences between the digital codes.

The threshold value may correspond to the highest grayscale voltage difference at which an abnormal characteristic does not result from crosstalk.

The constant may have a value varying according to the summation result of the first adder.

The constant may have a larger value according to an increase in the summation result.

The constant may have a fixed value.

The device may be included in any one of a source driver and a timing controller.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
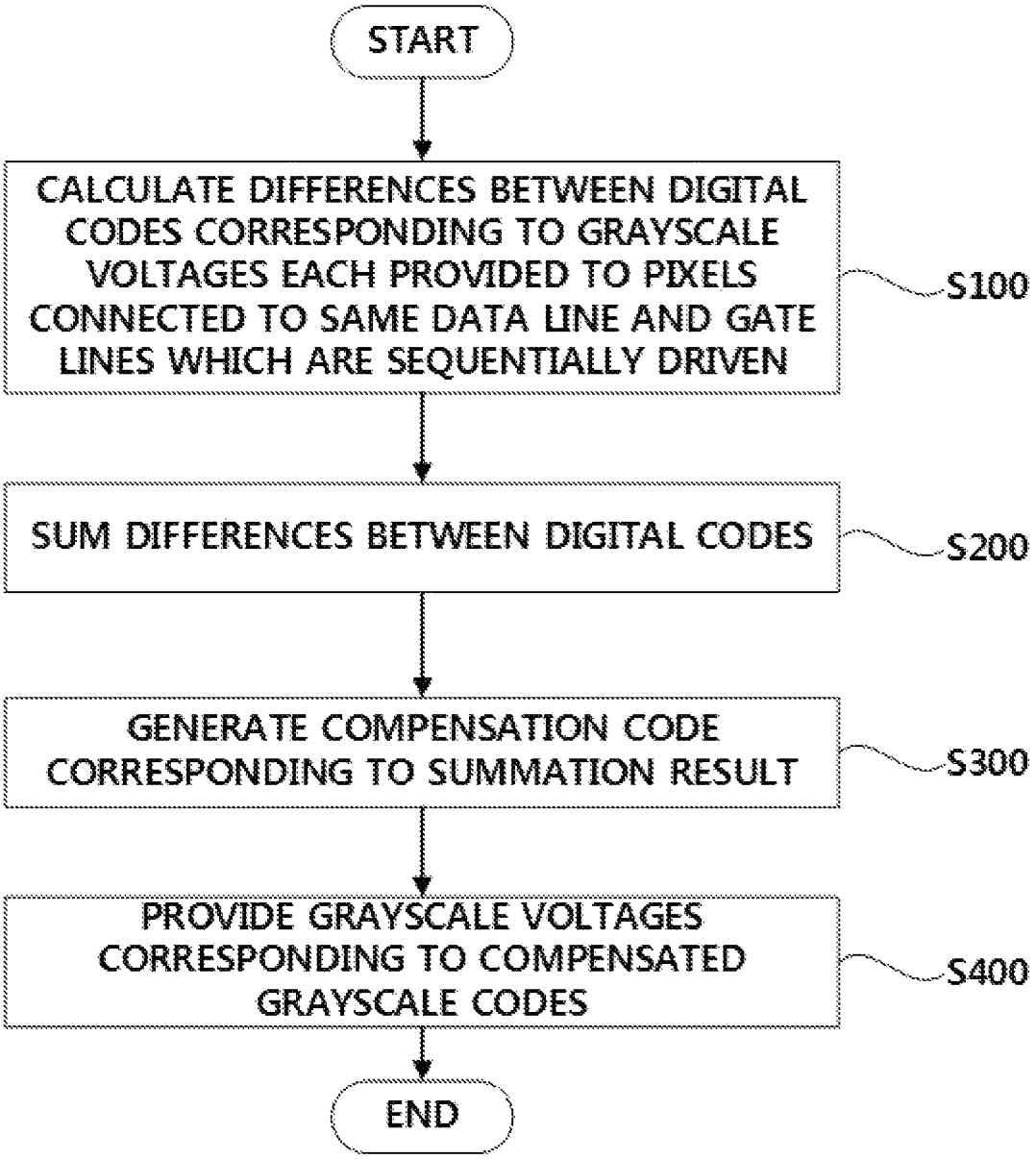
FIG. 1 is a flowchart schematically illustrating a method of driving a display according to an exemplary embodiment of the present invention.

Since descriptions of the present invention are mere embodiments for structural or functional description, the scope of the present invention should not be interpreted as being limited to the embodiments disclosed herein. In other words, the embodiments may be modified in various ways and implemented in various forms, and thus the scope of the present invention should be understood to include equivalents that may embody the technical spirit of the present invention.

Meanings of terms used herein should be understood as follows.

Singular forms are intended to include the plural forms as well, unless the context clearly indicates otherwise. It should be further understood that the terms "include," "have," or the like, when used herein, specify the presence of stated features, numbers, steps, operations, elements, parts, or combinations thereof but do not preclude the presence or addition of one or more other features, numbers, steps, operations, elements, parts, or combinations thereof.

Operations may be performed in a difference sequence from a described sequence unless the context clearly indicates a particular sequence. In other words, operations may be performed in the same sequence as the described sequence, may be performed substantially simultaneously, or may be performed in the reverse sequence.

In the drawings referred to in order to describe the embodiments of the present invention, the sizes, heights, and thicknesses of elements are intentionally exaggerated for convenience of description and easy understanding and are not enlarged or reduced according to magnification. Also, an element in the drawings may be intentionally reduced, and another element in the drawings may be intentionally enlarged.

Unless otherwise defined, all terms used herein have the same meaning as commonly understood by those of ordinary skill in the art to which the present invention pertains. It should be further understood that terms, such as those defined in commonly used dictionaries, should be interpreted as having a meaning which is consistent with their meaning in the context of the relevant art and will not be interpreted in an idealized or overly formal sense unless expressly so defined herein.

Hereinafter, a method of driving a display according to an embodiment of the present invention will be described with reference to the accompanying drawings. FIG. 1 is a flowchart schematically illustrating a method of driving a display according to the exemplary embodiment. Referring to FIG. 1, the method of driving a display according to the exemplary embodiment includes an operation S100 of calculating differences between digital codes corresponding to grayscale voltages each provided to pixels connected to the same data line and gate lines which are sequentially driven, an operation S200 of summing the digital code differences having a threshold value or more, an operation S300 of generating a compensation code corresponding to the summation result, and an operation S400 of providing grayscale voltages compensated with the compensation code to the pixels of which digital codes have a difference of less than the threshold value.

Figure 2:
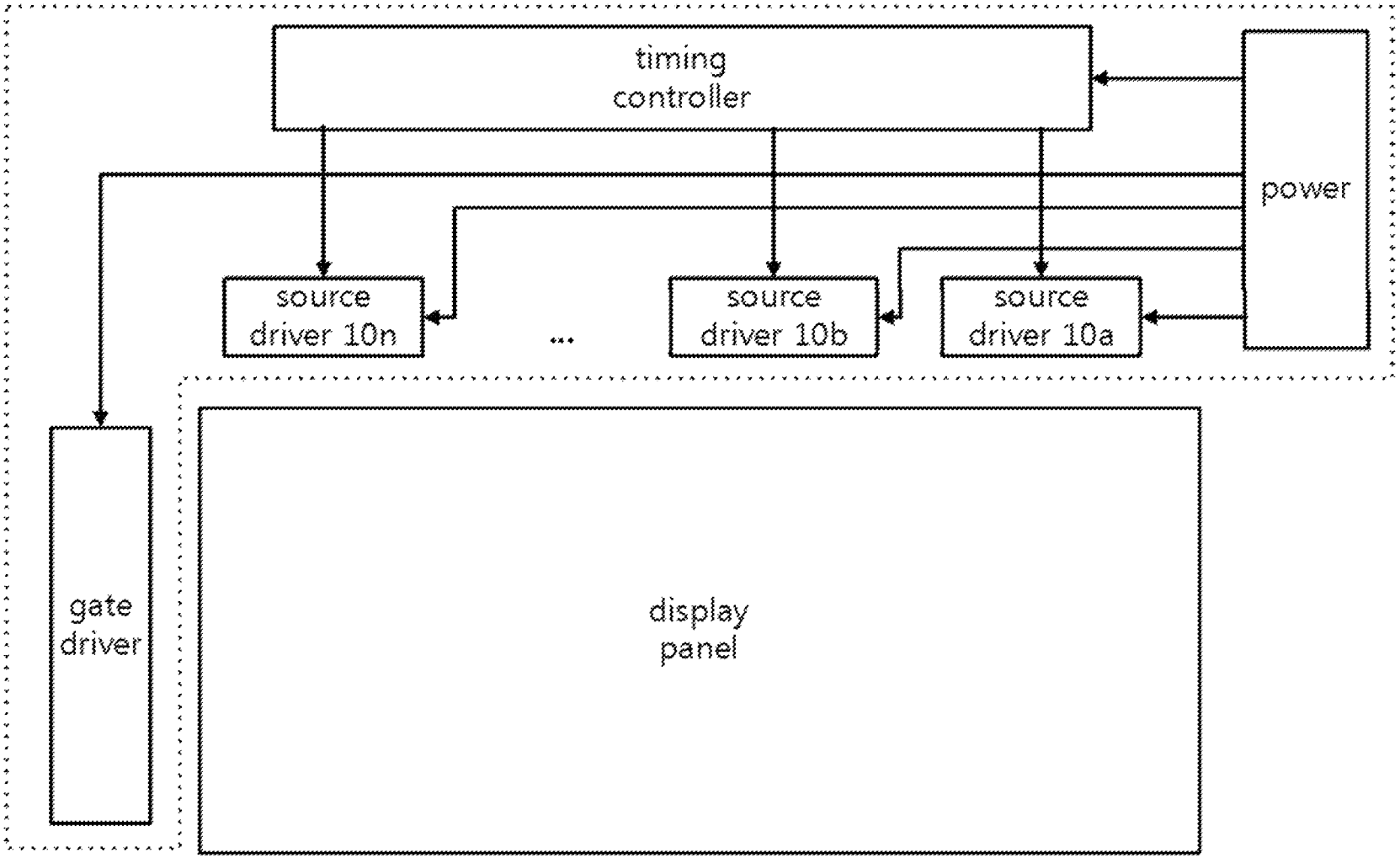
FIG. 2 is a diagram schematically showing a structure of a display system.

FIG. 2 is a diagram schematically showing a structure of a display system. Referring to FIG. 2, a display system according to the exemplary embodiment includes a display panel, a gate driver, source drivers 10*a*, 10*b*, . . . , and 10*n*, and a timing controller which changes characteristics of a screen source applied from the outside of the display system or adjusts a driving time point according to a resolution or characteristic of the display system.

The timing controller receives digital codes corresponding to an image to be displayed and provides the digital codes to the source drivers 10*a*, 10*b*, . . . , and 10*n*. The source drivers 10*a*, 10*b*, . . . , and 10*n* generate grayscale voltages corresponding to the digital codes provided by the timing controller and provide the grayscale voltages to pixels through data lines DLn−3, DLn−2, . . . , and DLn+4 (see FIG. 3). The gate driver provides gate signals through gate lines GLk−3, GLk−2, . . . , and GLk+4 (see FIG. 3) so that the pixels display grayscale levels corresponding to the provided grayscale voltages.

Figure 3:
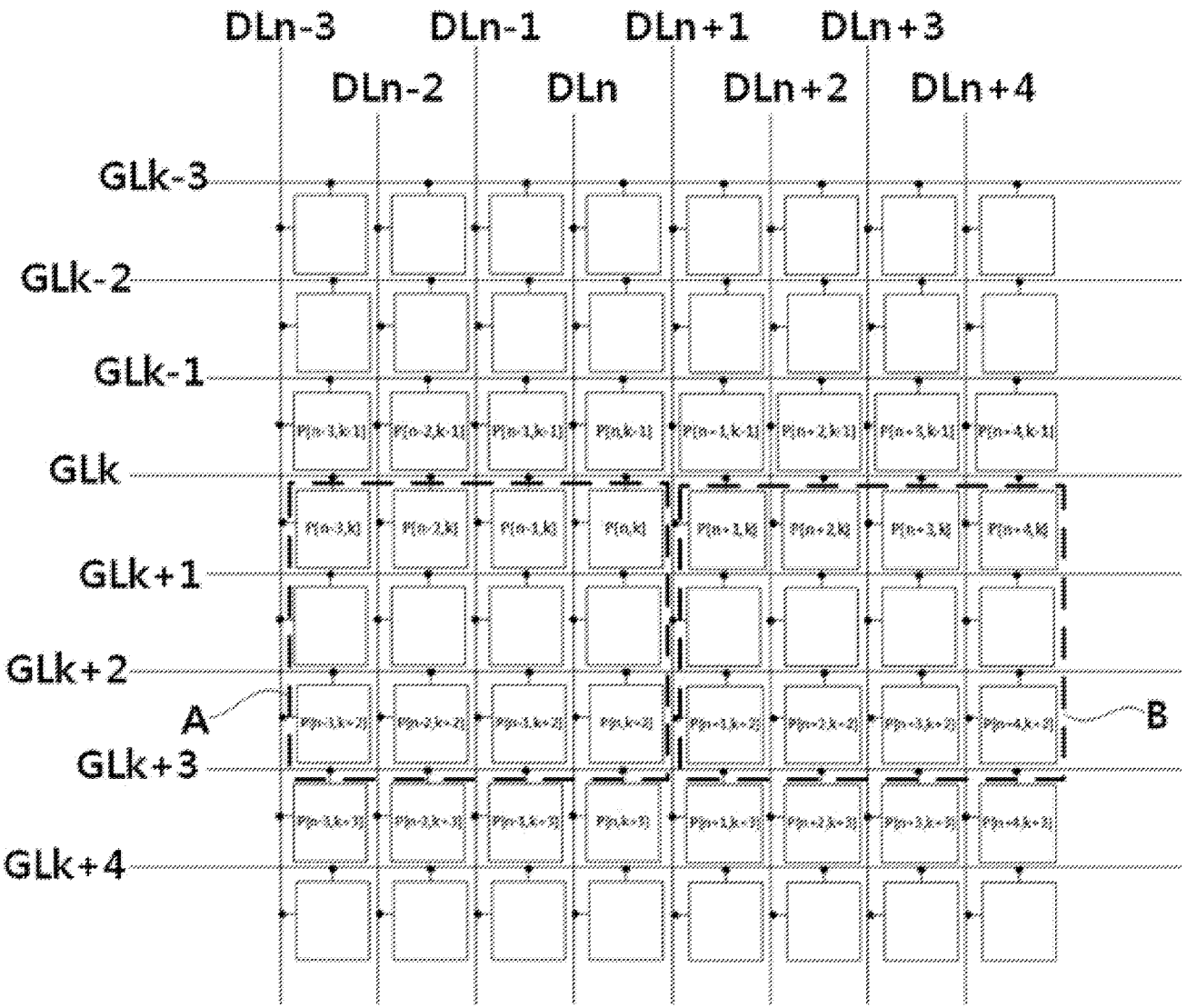
FIG. 3 is a diagram schematically showing a plurality of pixels connected to a plurality of gate lines connected to a gate driver included in a display panel shown in FIG. 2 and a plurality of data lines connected to a source driver included in the same.

FIG. 3 is a diagram schematically showing a plurality of pixels connected to the plurality of gate lines GLk−3, GLk−2, . . . , and GLk+4 connected to a gate driver included in a display panel shown in FIG. 2 and the plurality of data lines DLn−3, DLn−2, . . . , and DLn+4 connected to a source driver included in the same. Referring to FIG. 3, it is assumed that all pixels connected to the gate lines GLk−3, GLk−2, and GLk−1 display a white color, pixels included in A area indicated by a broken line display a black color, and pixels included in B area indicated by a broken line display the white color.

Figure 4A:
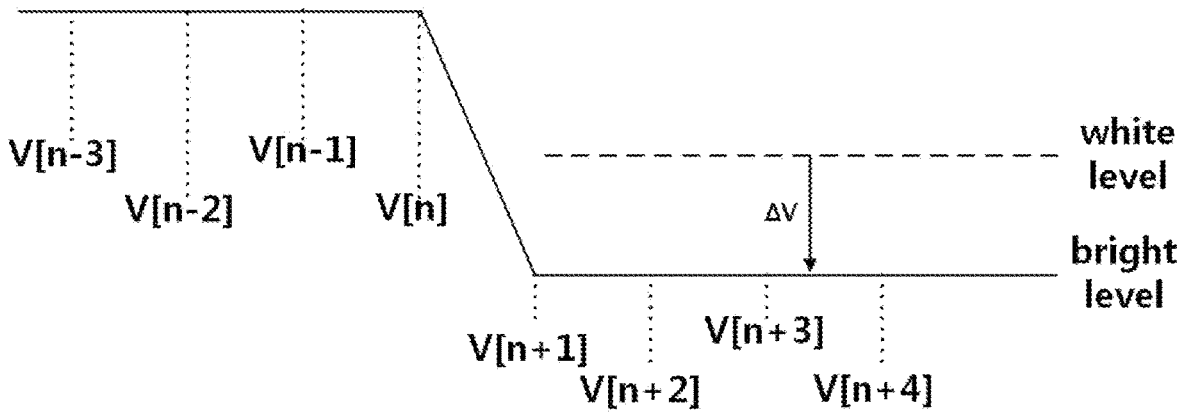
FIGS. 4A and 4B are diagrams schematically showing an abnormal characteristic, which comes into effect in B area, of grayscale voltages provided to pixels.

FIG. 4A schematically shows an abnormal characteristic, which comes into effect in B area, of grayscale voltages provided to pixels [n+1, k], P[n+2, k], P[n+3, k], and P[n+4, k]. Referring to FIG. 4A, voltages corresponding to a white level as indicated by the broken line should be provided to the pixels P[n+1, k], P[n+2, k], P[n+3, k], and P[n+4, k] in B area. However, as shown in the drawing, an error voltage ΔV is generated by crosstalk in grayscale voltages V[n+1], V[n+2], V[n+3], and V[n+4] which are provided to the pixels P[n+1, k], P[n+2, k], P[n+3, k], and P[n+4, k], and thus voltages corresponding to a bright level, which is brighter than a surrounding level as indicated by a solid line, are provided to the pixels. Accordingly, all the pixels P[n+1, k], P[n+2, k], P[n+3, k], and P[n+4, k] display brighter color than surrounding pixels.

Figure 4B:
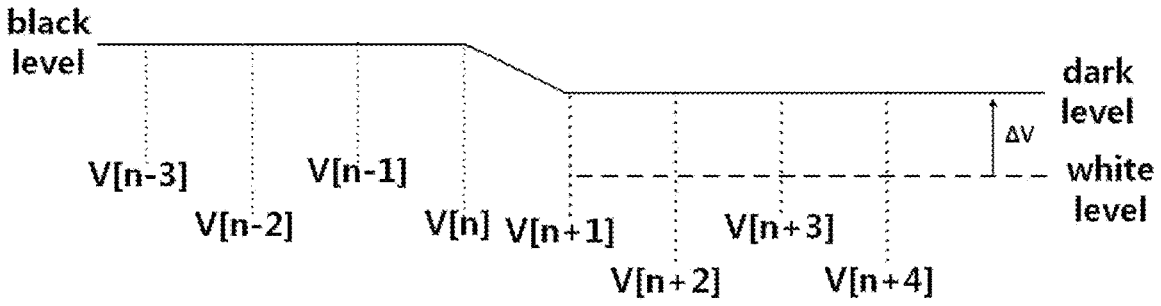

FIG. 4B schematically shows an abnormal characteristic, which comes into effect in B area, of grayscale voltages provided to pixels P[n+1, k+3], P[n+2, k+3], P[n+3, k+3], and P[n+4, k+3]. All pixels connected to the gate lines GLk+3 and GLk+4 display the white color, and pixels included in A area indicated by the broken line display the black color. Pixels included in B area indicated by the broken line should display the white color, but an abnormal characteristic comes into effect due to crosstalk at the pixels P[n+1, k+3], P[n+2, k+3], P[n+3, k+3], and P[n+4, k+3], which are the boundary of B area.

As shown in FIG. 4B, grayscale voltages V[n+1], V[n+2], V[n+3], and V[n+4] corresponding to a white level as indicated by the broken line should be provided to the pixels P[n+1, k+3], P[n+2, k+3], P[n+3, k+3], and P[n+4, k+3]. However, as shown in the drawing, an error voltage ΔV is generated by crosstalk, and thus voltages corresponding to a dark level, which is darker than a surrounding level as indicated by a solid line, are actually provided to the pixels. Accordingly, all the pixels P[n+1, k+3], P[n+2, k+3], P[n+3, k+3], and P[n+4, k+3] display darker color than surrounding pixels.

To solve the above-described abnormal characteristics which come into effect due to crosstalk, a difference is calculated between digital codes corresponding to grayscale voltages each provided to pixels which are connected to the same data line but separately connected to a $(k-1)^{th}$ gate line and a $k^{th}$ gate line (S100). For example, a difference is calculated between digital codes corresponding to a grayscale voltage provided to the pixel p[n−3, k−1] connected to the $(k-1)^{th}$ gate line GLk−1 and a grayscale voltage provided to the pixel p[n−3, k] connected to the $k^{th}$ gate line GLk. Also, a difference is calculated between digital codes corresponding to a grayscale voltage provided to the pixel p[n−2, k−1] connected to the $(k-1)^{th}$ gate line GLk−1 and a grayscale voltage provided to the pixel p[n−2, k] connected to the $k^{th}$ gate line GLk. According to the exemplary embodiment, the operation of calculating differences between digital codes may be performed regarding all pixels connected to the same gate line. Also, the operation of calculating differences between digital codes may be performed regarding pixels connected to two gate lines which are sequentially driven over time.

For example, a difference may be calculated between digital codes corresponding to grayscale voltages provided to pixels connected to the $(k-1)^{th}$ gate line and the $k^{th}$ gate line, and a difference may be calculated between digital codes corresponding to grayscale voltages provided to pixels connected to the $(k+1)^{th}$ gate line and the $(k+2)^{th}$ gate line. As such, a difference between digital codes may be calculated regarding pixels connected to two gate lines which are sequentially driven over time.

In the exemplary embodiment illustrated in FIG. 3, grayscale voltages provided to the pixels P[n−3, k−1], P[n−2, k−1], P[n−1, k−1], and P[n, k−1] correspond to voltages for displaying the white color, and grayscale voltages provided to the pixels P[n−3, k], P[n−2, k], P[n−1, k], and P[n, k] correspond to voltages for displaying the black color. For example, when a digital code corresponding to a voltage for displaying the black color has a larger binary value than a digital code corresponding to a voltage for displaying the white color, differences between digital codes provided to the pixels P[n−3, k−1], P[n−2, k−1], P[n−1, k−1], and P[n, k−1] and the pixels P[n−3, k], P[n−2, k], P[n−1, k], and P[n, k] are calculated to obtain results of positive numbers.

Grayscale voltages provided to the pixels P[n−3, k+2], P[n−2, k+2], P[n−1, k+2], and P[n, k+2] correspond to voltages for displaying the black color, and grayscale voltages provided to the pixels P[n−3, k+3], P[n−2, k+3], P[n−1, k+3], and P[n, k+3] correspond to voltages for displaying the white color. When a digital code corresponding to a voltage for displaying the black color has a larger binary value than a digital code corresponding to a voltage for displaying the white color, differences between digital codes provided to the pixels P[n−3, k+2], P[n−2, k+2], P[n−1, k+2], and P[n, k+2] and the pixels P[n−3, k+3], P[n−2, k+3], P[n−1, k+3], and P[n, k+3] are calculated to obtain results of negative numbers.

The differences of the digital codes which are larger than the threshold value are added (S200). For example, the threshold value may correspond to the highest grayscale voltage at which an abnormal characteristic does not result from crosstalk.

A larger difference between digital codes represents a larger difference between grayscale levels displayed by pixels. In other words, a difference between a digital code corresponding to a grayscale voltage provided to a pixel displaying the white color and a digital code corresponding to a grayscale voltage provided to a pixel displaying the black color is larger than a difference between digital codes corresponding to a grayscale voltage provided to pixels displaying the same grayscale level.

For example, differences between a digital code corresponding to a grayscale voltage provided to the pixels P[n−3, k−1], P[n−2, k−1], P[n−1, k−1], and P[n, k−1] displaying the white color and a digital code corresponding to a grayscale voltage provided to the pixel P[n−3, k], P[n−2, k], P[n−1, k], and P[n, k] displaying the black color is larger than differences between digital codes corresponding to grayscale voltages provided to the pixels P[n+1, k−1], P[n+2, k−1], P[n+3, k−1], and P[n+4, k−1] and the pixels P[n+1, k], P[n+2, k], P[n+3, k], and P[n+4, k] displaying the same white color.

According to the exemplary embodiment, an operation of comparing the result of summing the digital code differences with a reference value may be additionally performed because, when the summation result is smaller than a reference value, an abnormal color is not generated by crosstalk. Accordingly, when the result of summing the digital code differences is smaller than the reference value, the result of summing the digital code differences may not be ignored in a subsequent operation without generating a compensation code.

A compensation code corresponding to the summation result is generated (S300). The compensation code is a digital code corresponding to a voltage for compensating for an error voltage ΔV caused by crosstalk. As will be described below, the compensation code is added to a code corresponding to a grayscale voltage provided to each pixel to generate a compensated grayscale voltage.

The error voltage ΔV caused by crosstalk increases according to an increase in the difference between grayscale voltages provided to pixels and an increase in the number of pixels of which grayscale voltages have a large difference. Since the error voltage ΔV increases according to an increase in the result of summing the digital code differences, the compensation code for compensating for the error voltage ΔV is generated to be proportional to the summation result.

For example, as illustrated in FIG. 4A, when a grayscale level brighter than a grayscale level to be displayed is displayed due to crosstalk, a compensation code is generated to cancel out effects of the error voltage ΔV so that a grayscale voltage corresponding to a white level may be provided to pixels. As illustrated in FIG. 4B, when a grayscale level darker than that to be displayed is displayed due to crosstalk, a compensation code is generated to cancel out effects of the error voltage ΔV so that a grayscale voltage corresponding to a white level may be provided to pixels.

According to the exemplary embodiment, the operation of generating a compensation code may be performed by multiplying the result of summing the digital code differences by a constant. As an example, the constant may vary according to the summation result, and a constant determined when the summation result is small may be larger than a constant determined when the summation result is large. As another example, the constant may have a fixed value.

Grayscale voltages compensated with the compensation code are provided to pixels of which digital codes have a difference of less than the threshold value (S400). According to an exemplary embodiment, the source drivers receive a digital code corresponding to a grayscale level to be displayed by each pixel from the timing controller and add the compensation code to the digital code. The digital code to which the compensation code is added is converted into a grayscale voltage and provided to the pixel.

According to another exemplary embodiment, the timing controller adds the compensation code to a digital code corresponding to a grayscale level to be displayed by each pixel. The timing controller provides the digital code to which the compensation code is added to the source driver, and the source driver generates a grayscale voltage corresponding to the provided digital code and provides the grayscale voltage to the pixel.

Figure 5A:
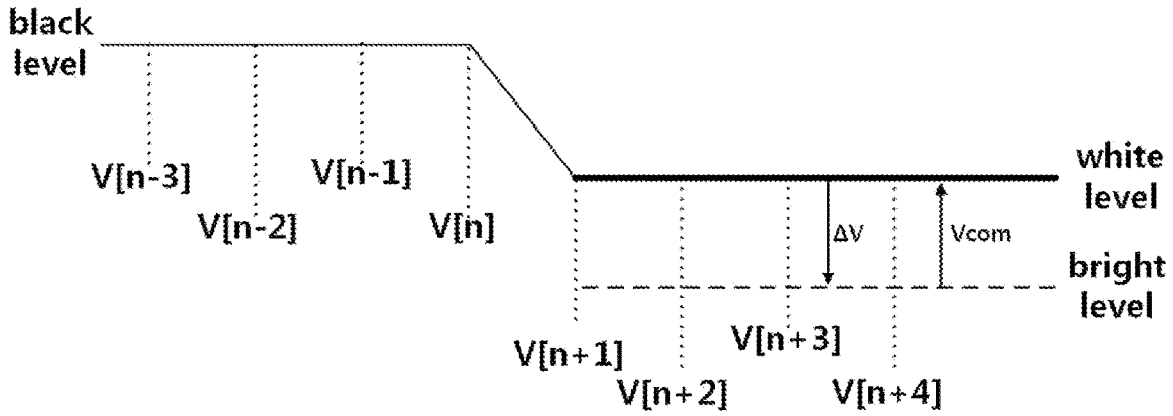
FIGS. 5A and 5B are diagrams showing cases of providing a compensated grayscale voltage in the examples shown in FIGS. 4A and 4B, respectively.
Figure 5B:
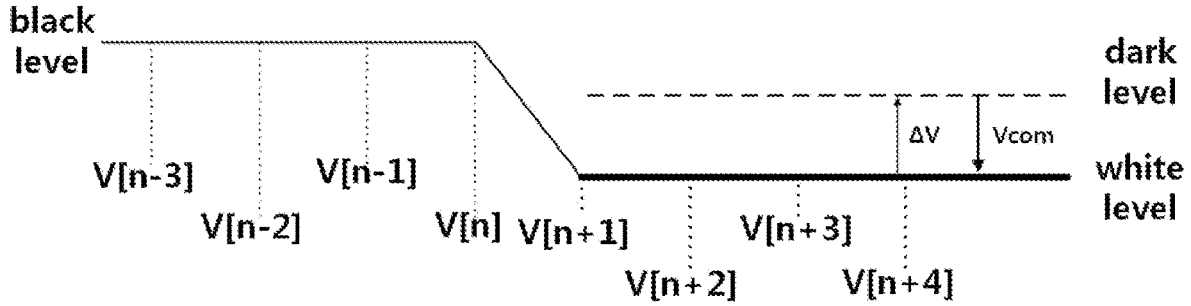

FIG. 5A illustrates a case of providing a compensated grayscale voltage in the example shown in FIG. 4A, and FIG. 5B illustrates a case of providing a compensated grayscale voltage in the example shown in FIG. 4B. Referring to FIG. 5A, the pixels P[n+1, k], P[n+2, k], P[n+3, k], and P[n+4, k] display a bright level which is brighter than surroundings due to the error voltage ΔV caused by crosstalk.

However, a compensation code for compensating for the error voltage ΔV is generated, and a voltage Vcom corresponds to the compensation code. Accordingly, a white-level grayscale voltage corresponding to a voltage obtained by adding Vcom is provided to the pixels so that an abnormal phenomenon caused by crosstalk may be prevented.

Referring to FIG. 5B, grayscale voltages generated as codes compensated for the error voltage ΔV caused by crosstalk with a compensation code are provided to the pixels P[n+1, k], P[n+2, k], P[n+3, k], and P[n+4, k]. In other words, a grayscale voltage corresponding to a white level to be actually displayed is provided to the pixels P[n+1, k], P[n+2, k], P[n+3, k], and P[n+4, k]. Accordingly, according to the exemplary embodiment, it is possible to solve an abnormal characteristic caused by crosstalk.

Figure 6:
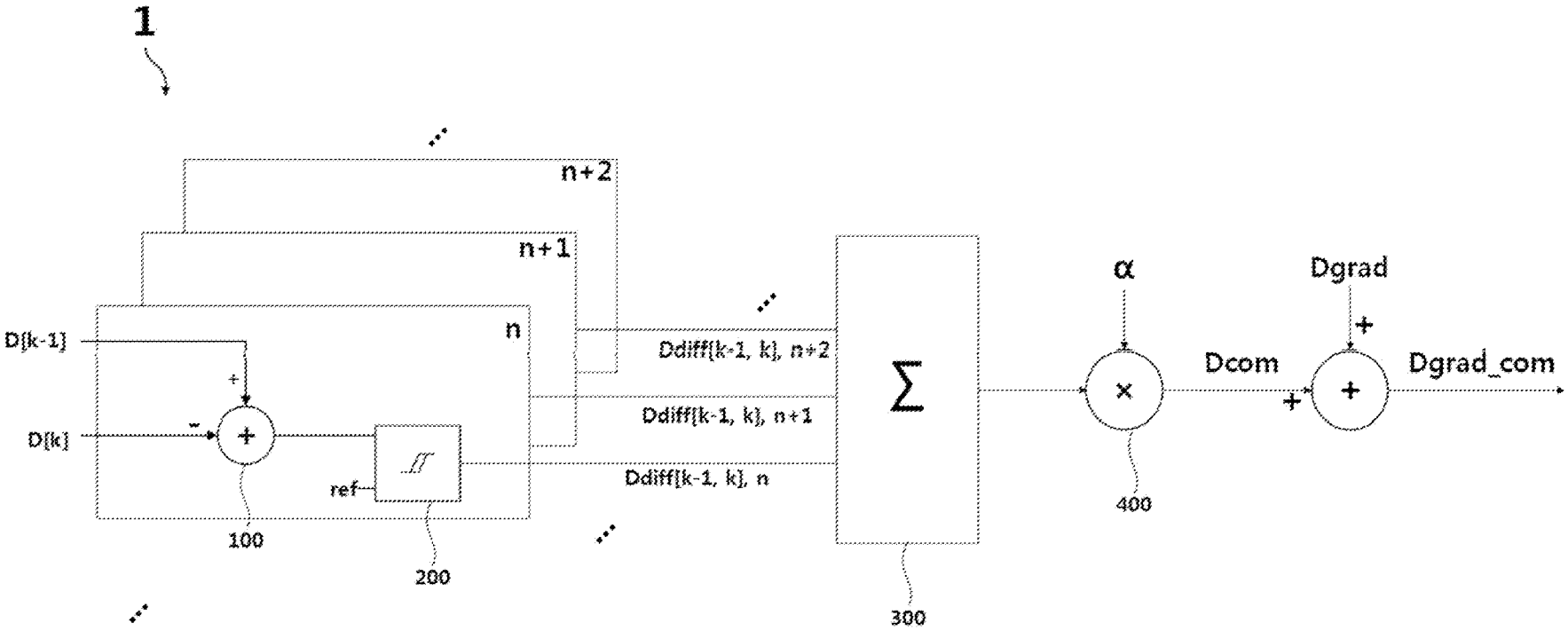
FIG. 6 is a schematic diagram of a device for driving a display according to an exemplary embodiment of the present invention.

FIG. 6 is a schematic diagram of a device 1 for driving a display according to an exemplary embodiment of the present invention. Operation of the device 1 will be described below with reference to FIG. 6. However, details which are identical or similar to those described above may be omitted. The device 1 may be included in the source drivers 10*a*, 10*b*, . . . , and 10*n* (see FIG. 2) or the timing controller (see FIG. 2).

The device 1 includes subtractors 100, each of which calculates the difference between digital codes D[k−1] and D[k] corresponding to grayscale voltages provided to pixels which are connected to the same data line and separately connected to the $(k-1)^{th}$ gate line GLk−1 and the $k^{th}$ gate line GLk, comparators 200, each of which compares the calculation result of the subtractor 100 with a threshold value ref and outputs the calculation result of the subtractor 100 when the calculation result is larger than the threshold value ref, an adder 300 which sums the calculation results, and a multiplier 400 which generates a compensation code Dcom by multiplying the calculation result of the adder 300 by a constant α.

Each of the subtractors 100 calculates the difference between the digital codes D[k−1] and D[k] corresponding to grayscale voltages provided to pixels which are connected to the same data line and separately connected to the $(k-1)^{th}$ gate line GLk−1 and the $k^{th}$ gate line GLk.

In the illustrated embodiment, each of the comparators 200 determines whether a digital code difference Ddiff[k−1, k] calculated by the subtractor 100 is the threshold value ref or more and outputs the digital code difference Ddiff[k−1, k] calculated by the subtractor 100 when the digital code difference Ddiff[k−1, k] is the threshold value or more. As described above, the digital codes D[k−1] and D[k] input to the substractor 100 correspond to grayscale voltages provided to two pixels connected to two gate lines, which are sequentially driven, and the same data line.

The adder 300 sums the digital code differences which are calculated by the subtractors 100 to be the threshold value ref or more and outputs the summation result. The summation result output by the adder 300 increases according to an increase in the grayscale voltage difference between pixels and an increase in the number of pixels of which grayscale voltages have a large difference.

According to another exemplary embodiment not shown in the drawings, the adder 300 sums the digital code differences calculated by the substractors 100 and outputs the summation result. The summation result output by the adder 300 is compared with a reference value ref by a comparator (not shown), and when the result of summing the code differences is smaller than the threshold value, there is a low probability that an abnormal characteristic results from crosstalk, and thus the summation result is ignored. However, when the result of summing the code differences is the threshold value or more, the result of summing the code differences is provided to the multiplier 400.

The multiplier 400 generates a compensation code Dcom by multiplying the summation result output by the adder 300 by a constant α. As an example, the constant α may vary according to the summation result output by the adder 300, and the constant α determined when the summation result is small may be larger than the constant α determined when the summation result is large. As another example, the constant may have a fixed value.

A compensated grayscale code Dgrad_com is generated by summing the compensation code Dcom and a digital code Dgrad corresponding to a grayscale voltage to be displayed by a pixel. The compensated grayscale code Drad_com may be generated by the timing controller (see FIG. 2) or the source drivers 10*a*, 10*b*, . . . , and 10*n* (see FIG. 2). A compensated grayscale voltage corresponding to a compensated grayscale code is generated and provided to pixels of which digital codes have a difference of a threshold value or less. Accordingly, it is possible to solve an abnormal characteristic caused by crosstalk. According to the exemplary embodiment, a source driver may receive a compensated grayscale code and generate and provide a compensated grayscale voltage to target pixels.

According to an exemplary embodiment, it is possible to remove an abnormal characteristic caused by crosstalk.

Although the present invention has been described with reference to embodiments shown in the drawings to aid in understanding, the embodiments are exemplary, and those of ordinary skill in the art should appreciate that various modifications and other equivalent embodiments can be made from the embodiments. Consequently, the technical range of the present invention is defined by the following claims.

What is claimed is:

1. A method of driving a display, the method comprising:

calculating differences between digital codes corresponding to grayscale voltages each provided to pixels connected to the same data line and gate lines which are sequentially driven;

summing the differences between the digital codes;

generating a compensation code corresponding to a result of the summation;

generating compensated grayscale codes by adding the compensation code to the digital codes corresponding to the grayscale voltages; and providing grayscale voltages corresponding to the compensated grayscale codes.

2. The method of claim 1, wherein the calculating of the differences between the digital codes comprises calculating a difference between a digital code corresponding to a grayscale voltage provided to a pixel driven $k^{th}$ and a digital code corresponding to a grayscale voltage provided to a pixel driven $(k+1)^{th}$ (where k is a natural number).

3. The method of claim 1, wherein the calculating of the differences between the digital codes comprises calculating a difference between digital codes corresponding to grayscale voltages each provided to pixels connected to the same data line and two gate lines which are sequentially driven.

4. The method of claim 1, further comprising:

comparing the differences between the digital codes with a threshold value; and when the differences between the digital codes are smaller than the threshold value, discarding the differences between the digital codes.

5. The method of claim 4, wherein the providing of the grayscale voltages corresponding to the compensated grayscale codes comprises providing the grayscale voltages corresponding to the compensated grayscale codes to the pixels of which the digital codes have a difference of less than the threshold value.

6. The method of claim 4, wherein the threshold value corresponds to the highest grayscale voltage difference at which an abnormal characteristic does not result from crosstalk.

7. The method of claim 1, wherein the generating of the compensation code comprises multiplying the summation result by a constant.

8. The method of claim 7, wherein the constant has a value varying according to the summation result.

9. The method of claim 7, wherein the constant has a larger value according to an increase in the summation result.

10. The method of claim 7, wherein the constant has a fixed value.

11. The method of claim 1, wherein the method is performed by any one of a source driver and a timing controller.

12. The method of claim 1, further comprising:

comparing the result of summing the differences between the digital codes with a threshold value; and when the summation result is smaller than the threshold value, discarding the summation result.

13. A device for driving a display, comprising:

subtractors configured to calculate differences between digital codes corresponding to grayscale voltages each provided to pixels connected to the same data line and gate lines which are sequentially driven;

a first adder configured to sum the differences between the digital codes;

a multiplier configured to generate a compensation code by multiplying a result of the summation by a constant; and a second adder configured to generate compensated grayscale codes by adding the compensation code to the digital codes corresponding to the grayscale voltages.

14. The device of claim 13, wherein the subtractors calculate a difference between a digital code corresponding to a grayscale voltage provided to a pixel driven $k^{th}$ and a digital code corresponding to a grayscale voltage provided to a pixel driven $(k+1)^{th}$ (where k is a natural number).

15. The device of claim 13, further comprising comparators configured to compare the differences between the digital codes with a threshold value, wherein when the differences between the digital codes are smaller than the threshold value, the comparators discard the differences between the digital codes.

16. The device of claim 15, wherein the threshold value corresponds to the highest grayscale voltage difference at which an abnormal characteristic does not result from crosstalk.

17. The device of claim 13, further comprising a comparator configured to compare the result, which is a calculation result of the first adder obtained by summing the differences between the digital codes, with a threshold value, wherein when the summation result is smaller than the threshold value, the comparator discards the differences between the digital codes.

18. The device of claim 13, wherein the constant has a value varying according to the summation result of the first adder.

19. The device of claim 13, wherein the constant has a larger value according to an increase in the summation result.

20. The device of claim 13, wherein the constant has a fixed value.

21. The device of claim 13, wherein the device is included in any one of a source driver and a timing controller.

* * * * *